United States Patent [19]

Okuda et al.

[11] Patent Number: 4,685,370

[45] Date of Patent: Aug. 11, 1987

[54] AUTOMATIC RHYTHM PLAYING APPARATUS HAVING PLURALITY OF RHYTHM PATTERNS FOR A RHYTHM SOUND

[75] Inventors: Hiroko Okuda; Hiroshi Iwase, both of Tokyo, Japan

[73] Assignee: Casio Computer Co., Ltd., Tokyo, Japan

[21] Appl. No.: 828,238

[22] Filed: Feb. 10, 1986

[30] Foreign Application Priority Data

Feb. 18, 1985 [JP] Japan ..... 60-28380

[51] Int. Cl.[4] ..... G10H 1/42; G10H 7/00

[52] U.S. Cl. ..... 84/1.03; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 4,217,806 | 8/1980 | Sakai et al. | 84/1.03 |
| 4,315,451 | 2/1982 | Uchiyama et al. | 84/1.03 |
| 4,467,690 | 8/1984 | Nishimoto | 84/1.03 |
| 4,481,853 | 11/1984 | Ishikawa | 84/1.03 |
| 4,526,079 | 7/1985 | Oguri | 84/1.03 |

*Primary Examiner*—S. J. Witkowski

*Attorney, Agent, or Firm*—Frishauf, Holtz, Goodman and Woodward

[57] ABSTRACT

A plurality of different kinds of rhythm playing pattern data corresponding to each of the different rhythm sounds being used to play specified rhythms is stored in a rhythm pattern memory section (1). When a particular kind of rhythm is being played automatically, one particular kind of rhythm is selectively designated from a plurality of kinds of rhythms by the operation of the rhythm kind selecting unit (21*f*). Then, a particular kind of rhythm playing pattern data corresponding to the selected particular kind of rhythm is selected from a plurality of kinds of rhythm playing pattern data preset in the rhythm pattern memory section (1) corresponding to each of the rhythm sounds by the operation of the pattern selection section (2,21,21*a*–21*e*). According to this arrangement, since a plurality of rhythm playing patterns are preset to each of the rhythm sounds for each different kind of rhythm, an automatic rhythm play using a selected one of a plurality of rhythm playing patterns can be performed for each rhythm sound by the selecting operation of the pattern selection section (2,21,21*a*–21*e*), though the same kind of rhythm is automatically played with the same rhythm sound.

9 Claims, 11 Drawing Figures

FIG. 3

| | FUNCTION OF BIT / ADDRESS | MSB CY M | H | R S | L C | H C | S N | B D | ACTUAL TIMING |
|---|---|---|---|---|---|---|---|---|---|
| I | POINTER 1 (0) | 0 | 1 | 0 | 0 | 0 | 0 | 1 | |
| | | 0 | 1 | 0 | 0 | 0 | 0 | 0 | |
| | | 0 | 0 | 0 | 0 | 0 | 0 | 0 | |
| | | 0 | 1 | 0 | 0 | 0 | 1 | 0 | |
| | | 0 | 1 | 0 | 0 | 0 | 0 | 0 | |
| | | 0 | 1 | 0 | 0 | 0 | 0 | 1 | |
| | | 0 | 1 | 0 | 0 | 0 | 0 | 1 | |
| | | 0 | 1 | 0 | 0 | 0 | 1 | 0 | |
| | | 0 | 0 | 0 | 0 | 0 | 0 | 0 | |
| | | 1 | 0 | 0 | 0 | 0 | 0 | 0 | |
| | | 0 | 0 | 0 | 0 | 0 | 0 | 0 | |
| II | POINTER 2 (11) | 1 | 0 | 0 | 0 | 0 | 0 | 1 | |
| | | 1 | 0 | 0 | 0 | 0 | 0 | 0 | |
| | | 1 | 0 | 0 | 0 | 0 | 0 | 0 | |
| | | 1 | 0 | 1 | 0 | 0 | 0 | 0 | |
| | | 1 | 0 | 0 | 0 | 0 | 0 | 1 | |
| | | 1 | 0 | 0 | 0 | 0 | 0 | 1 | |
| | | 1 | 0 | 0 | 0 | 1 | 0 | 0 | |
| | | 1 | 0 | 1 | 1 | 0 | 0 | 0 | |
| | | 0 | 0 | 0 | 0 | 0 | 0 | 0 | |
| | | 1 | 0 | 0 | 1 | 0 | 0 | 0 | |
| | | 0 | 0 | 0 | 0 | 0 | 0 | 0 | |
| III | POINTER 3 (22) | 0 | 1 | 0 | 0 | 0 | 0 | 1 | |
| | | 0 | 1 | 0 | 0 | 0 | 0 | 0 | |
| | | 0 | 0 | 0 | 0 | 0 | 0 | 1 | |
| | | 0 | 1 | 0 | 0 | 0 | 1 | 0 | |
| | | 0 | 1 | 0 | 1 | 0 | 0 | 0 | |
| | | 0 | 1 | 0 | 0 | 0 | 0 | 1 | |
| | | 0 | 1 | 0 | 0 | 0 | 1 | 0 | |
| | | 0 | 1 | 0 | 0 | 0 | 0 | 0 | |
| | | 0 | 0 | 0 | 0 | 0 | 0 | 1 | |
| | | 0 | 1 | 0 | 1 | 0 | 1 | 0 | |
| | | 0 | 0 | 0 | 1 | 0 | 0 | 0 | |

12

AUTOMATIC RHYTHM PLAYING APPARATUS HAVING PLURALITY OF RHYTHM PATTERNS FOR A RHYTHM SOUND

BACKGROUND OF THE INVENTION

This invention relates to an automatic rhythm playing apparatus, which automatically produces rhythm according to stored rhythm pattern data.

In a prior art automatic rhythm playing apparatus, rhythm sounds such as rock, disco, waltz, etc. are provided. A rhythm pattern suited for a content of melody performance is selected for automatic rhythm play by operating a rhythm select switch.

For example, a rhythm play of rock or disco is done with a pattern where musical tones of percussion musical instruments such as high conga, high hat, bass drum, claves and cymbals are sounded in a predetermined order. However, with the prior art automatic rhythm playing apparatus only a single percussion instrument combination pattern is provided for each of rhythms such as rock and disco. Therefore, the rhythm play is rather monotonous, so that it has been impossible to produce rich expression of the rhythm play.

SUMMARY OF THE INVENTION

An object of the invention is to provide an automatic rhythm playing apparatus, which permits variations of each rhythm play pattern, has high operability of pattern switching and permits rich expression of musical performance.

According to the invention, there is provided an automatic rhythm playing apparatus, which comprises a rhythm sound generating means capable of generating a plurality of different rhythm sounds, rhythm pattern memory means for storing a plurality of rhythm playing pattern data corresponding to each of the rhythm sounds in the respective rhythms, pattern selection means for selectively designating one of the plurality of rhythm playing pattern data for each of the rhythm sounds, tempo setting means for setting rhythm playing tempo, reading means for reading the rhythm playing pattern data designated by the pattern selection means according to a tempo set by the tempo setting means, and rhythm playing means for playing rhythm by driving the rhythm sound generating means according to the rhythm playing pattern data read out by the reading means.

Further, according to the invention, there is provided an automatic rhythm playing apparatus, which comprises a rhythm kind selection means capable of selecting kinds of rhythms, pattern selection means for selecting a rhythm playing pattern corresponding to a plurality of rhythm sounds for respective rhythms selected by the rhythm kind selection means, rhythm pattern memory means for storing rhythm playing pattern data for each of the rhythm sounds in the respective rhythms, rhythm sound generation means capable of generating the plurality of rhythm sounds, and control means for reading out from said rhythm pattern memory means a rhythm playing pattern data designated according to the respective rhythm sounds selected by said pattern selection means with respect to a particular kind of rhythm selected by said rhythm kind selection means, and for supplying the read out rhythm playing pattern data to said rhythm sound generation means so as to generate a rhythm sound according to said rhythm playing pattern data.

With the above construction, rhythm playing pattern data of a plurality of different patterns are stored for each of different rhythm sounds such as cymbals, high conga and bass drum with respect to each rhythm such as rock, disco, etc. Thus, various rhythm playing patterns can be selected for each percussion instrument as a rhythm source when providing the rhythm of rock, for instance, so that it is possible to produce rhythm rich in variations.

Further, since data for a plurality of rhythm playing patterns is stored for each of the rhythm sounds, pattern switching of rhythm play can be readily done for a rhythm sound with high operability even during performance. Particularly, the beginner can learn the patterns of the individual rhythm sounds and recognize pattern changes for each rhythm sound very well. Further, only a specific rhythm pattern in the rhythm pattern can be changed, so that it is possible to very subtle nuance of rhythm and enjoy rich expression of the rhythm play.

BRIEF DESCRIPTION OF THE DRAWINGS

FIG. 3 is a view showing data stored in an on/off register shown in FIG. 2;

DETAILED DESCRIPTION OF THE PREFERRED EMBODIMENT

Now, an embodiment of the invention will be described in detail with reference to the drawings.

Figure 1:
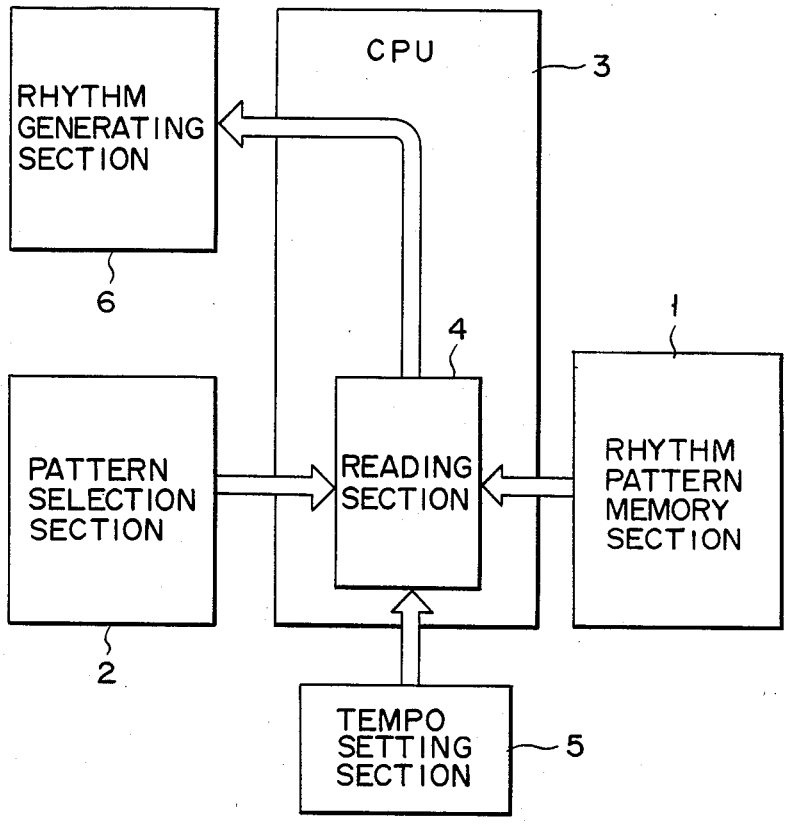
FIG. 1 is a block diagram schematically showing the automatic rhythm playing apparatus according to the invention.

Prior to describing an embodiment of the invention, an outline of the invention will be given with reference to FIG. 1. Referring to FIG. 1, rhythm pattern memory section 1 includes a ROM, in which a plurality of rhythm playing pattern data of rock, disco, etc. is stored for each of rhythm sources such as bass drum, cymbal, etc. Rhythm playing patterns are selected according to an output from pattern selection section 2. Pattern selection section 2 provides a pattern designation signal which is fed to reading section 4 provided in CPU 3. The pattern selection section 2 has a rhythm name selection switch group for designating kinds of rhythms such as rock, waltz and march and a pattern selection switch group for selecting one of rhythm patterns for each of sound sources with respect to the rhythm selected by the selection switch group. To reading section 4 is supplied a count value corresponding to a tempo which is preset in tempo setting section 5. Every time the count value is incremented, reading section 4 provides an address signal which designates an area of rhythm pattern memory section 1 corresponding to the pattern designation signal provided from pattern selection section 2. In response to this area designation, rhythm playing pattern data for individual rhythm sources are read out independently from rhythm pattern memory section 1.

Rhythm playing pattern data read out for each rhythm source is fed to rhythm generating section 6 for each rhythm source to produce rhythm sounds.

Thus, a rhythm pattern of rock, for instance, can be performed in various combined patterns by merely switching rhythm playing patterns in rhythm selection section 2.

Now, an embodiment of the invention will be described in detail with reference to FIG. 2 and following Figures. In this embodiment, rhythm pattern data is stored as two separate data, i.e., on/off data representing the "on" and "off" of a rhythm sound alone and timing data representing the timing of "on" alone, in on/off register 12 and timing register 13, respectively, in rhythm pattern memory section 1 formed of a ROM.

In on/off register 12 and timing register 13 are stored a plurality of different rhythm playing pattern data of rock, disco, waltz, etc. In the following description, the rhythm of rock is taken as an example.

Figure 4:
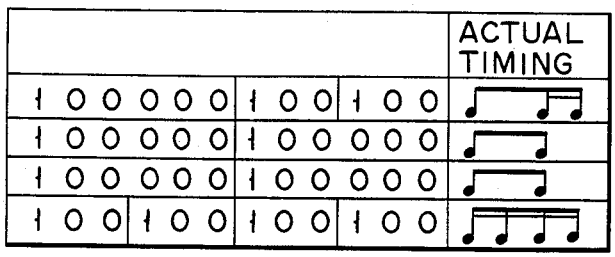
FIGS. 4 to 6 are views showing data stored in a timing register, a rhythm generation flag register and a sounding source flag register.

FIGS. 3 and 4 show data in on/off register 12 and timing register 13 about the rhythm of rock.

Figure 7:
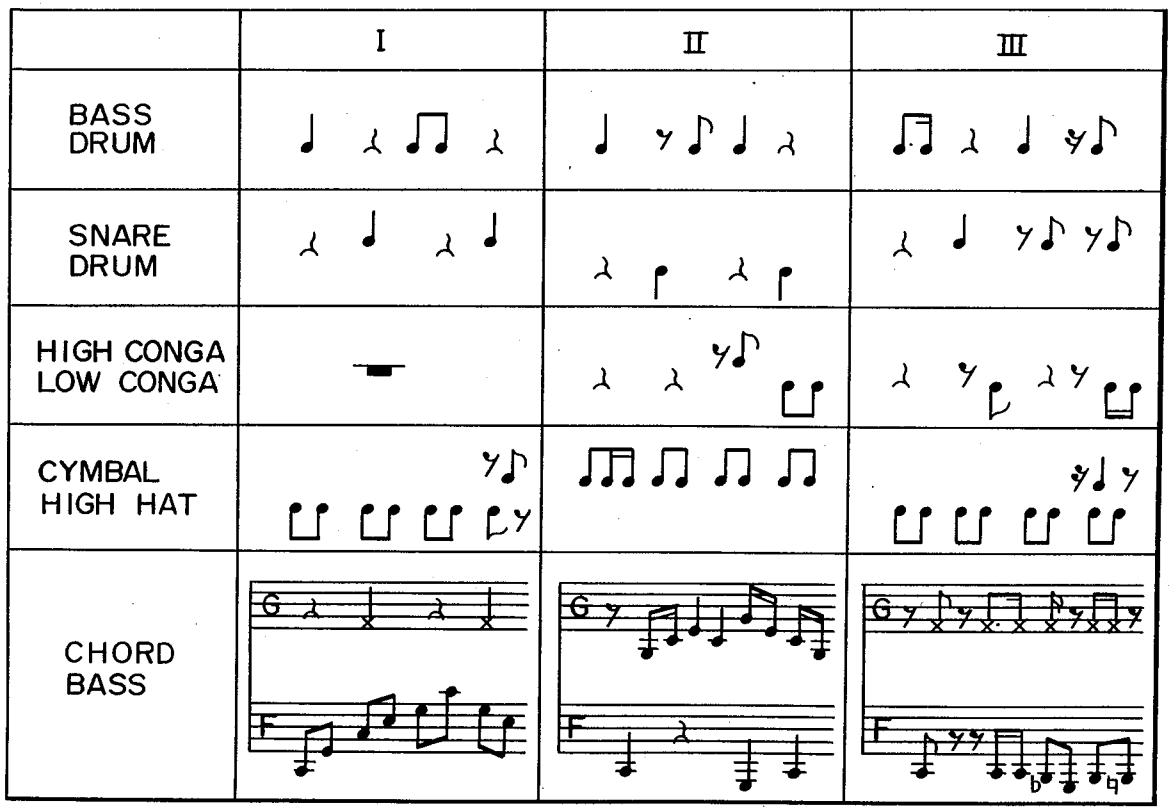
FIG. 7 is a view showing a rhythm pattern and accompaniment pattern of each rhythm source with respect to rock.

Rhythm performance pattern data I to III as shown in FIG. 7 are stored independently and as parallel data in on/off register 12 for seven different rhythm sources of bass drum (BD), snare drum (SN), high conga (HC), low conga (LC), rim shot (RS), high hat (HH) and cymbal (CYM). On/off data as shown in FIG. 3, the bits of which are "1" when corresponding rhythm is "on" and "0" when the rhythm is "off", are stored independently of the timing of sounding but in the order of sounding in the rhythm pattern. For example, in rhythm pattern I high hat (HH) and bass drum (BD) are "on" while the other rhythm sources are "off" at the first timing of sounding.

In timing register 13 are stored timing data as shown in FIG. 4. These data are serial data, the bits of which are "1" at a timing at which either one of the seven rhythm sources noted above is "on" and "0" at a timing at which all the rhythm sources are "off". Here, a sixteenth-note, which is the shortest note, is represented by three bits "100". Thus, an eighth-note is represented by six bits as "100000". Every time "on" timing data "1" is read out from timing register 13, on/off data is read out from on/off register 12, so that rhythm is sounded.

Figure 2:
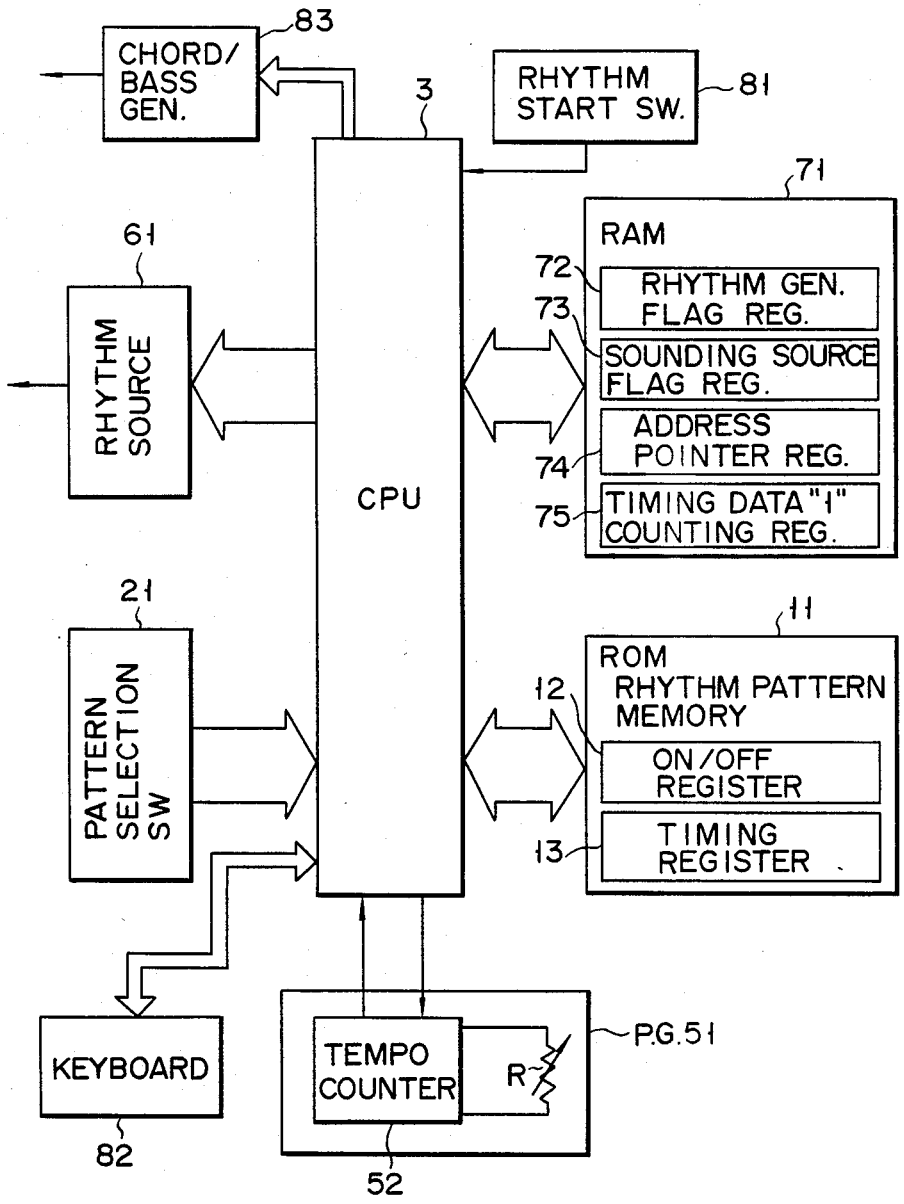
FIG. 2 is a block diagram showing the circuitry of an embodiment of the invention.

Referring to FIG. 2, RAM 71 includes rhythm generation flag register 72, sounding source flag register 73, address pointer register 74 and timing data "1" counting register 75.

Figure 5:
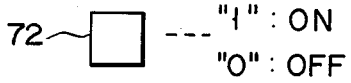

CPU 3 reads out on/off data from on/off register 12 into rhythm generation flag register 72 at a tempo corresponding to the rate of incrementation of tempo counter 52 in pulse generating section 51. When the on/off data is "1", an "on" flag of "1" is set. FIG. 5 shows rhythm generation flag register 72, which is a one-bit register. Pulse generator 51 has variable resistor VR, so that the frequency of the generated pulse output, i.e., the tempo, is variable.

Address pointer register 74 is an address register for reading data out of on/off register 12. Data which is set in address pointer register 74 has a value, which is the sum of the first address pointer of an area corresponding to either one of rhythm patterns I to III (FIG. 7) designated by pattern selection switch 21 and the number of "on" data "1" that have already been read out as timing data in timing register 13.

Figure 8:
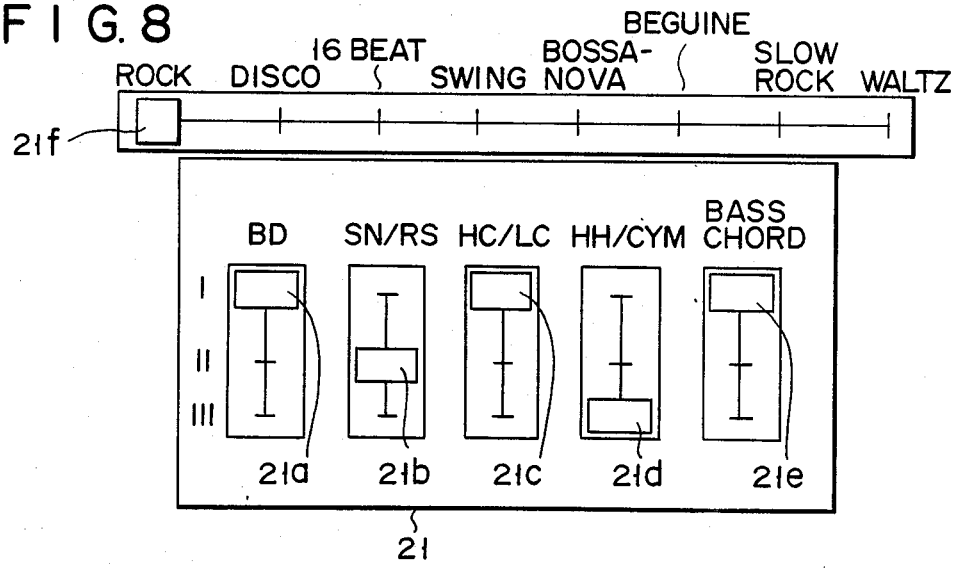
FIG. 8 is a plan view showing an operating section of a rhythm and pattern selection switch shown in FIG. 2.

In this embodiment, as shown in FIG. 8, one of eight rhythms such as rock, disco and the like can be selected by operating rhythm name selection switch 21*f* of slide switch type. The rhythm selected from the eight different kinds of rhythms 21*f* can be played by selectively using seven rhythm sources designated by pattern selection switch 21. These seven rhythm sources are allotted to four rhythm selection switches 21*a* to 21*d* constituting rhythm selection switch 21.

Pattern selection switch 21 is a lever type switch for switching rhythm patterns I to III for each of the seven rhythm sources. Switch 21*a* is for bass drum (BD). Switch 21*b* is for snare drum (SN) and rim shot (RS), these rhythm sources being of the same rhythm pattern. Likewise, switch 21*c* is for high conga (HC) and low conga (LC), and switch 21*d* is for high hat (HH) and cymbal (CYM). Switch 21*e* is for switching chord and bass of the data of rhythm patterns I to III shown at the bottom of FIG. 7.

Figure 6:
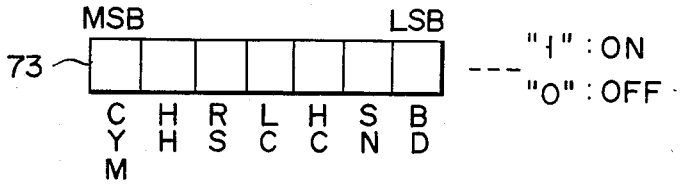

In sounding source flag register 73 are set on/off data which are read out from on/off register 12 independently for the individual rhythm sources. It has a 7-bit configuration for the seven rhythm sources, as shown in FIG. 6.

Rhythm source group 61 can provide the seven different rhythm sounds. Only a rhythm, for which the data in sounding source flag register 73 is "1", is sounded when the data of rhythm generation flag register 72 is "1" under the control of CPU 3.

In the circuit shown in FIG. 2, rhythm start switch 81, keyboard 82 and chord/bass generator 83 are connected to CPU 3. Rhythm start switch 81 is for supplying a rhythm start signal to CPU 3. Keyboard 82 is for designate chords, and data corresponding to a designated chord is fed to CPU 3. Chord/bass generator 82 generates a chord sound according to the chord designated by keyboard 82.

The operation of the above construction of the embodiment will now be described. It is assumed that levers 21*a* to 21*e* of pattern selection switch 21 shown in FIG. 8 have been operated to set bass drum (BD) and high conga (HC)/low conga (LC) in pattern I, snare drum (SN)/rim shot (RS) in pattern II, high hat (HH)/cymbal (CYM) in pattern III and bass/chord in pattern I for automatic rhythm play with pulse generator 51 set to a predetermined pulse frequency, i.e., a predetermined tempo. With this setting, a rhythm pattern of rock rhythm as shown in FIG. 7 is provided from each rhythm source.

Figure 9:
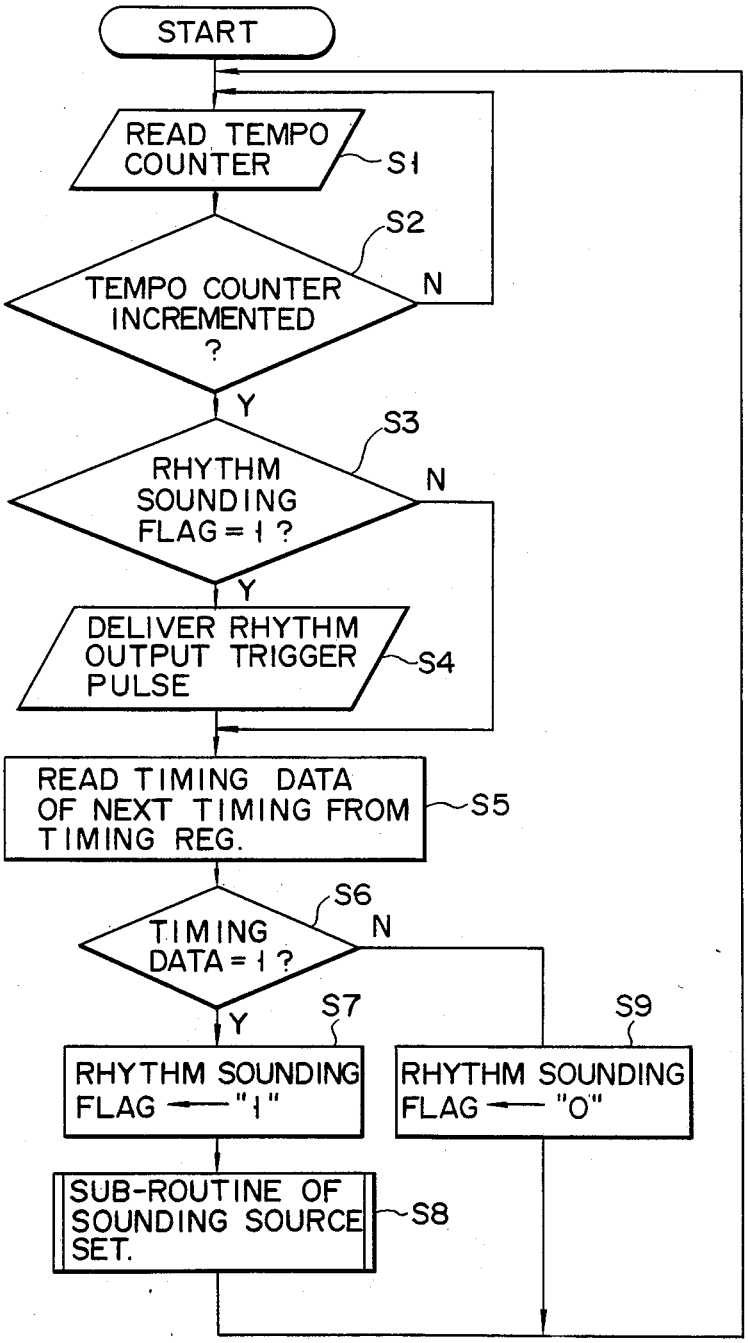
FIGS. 9 to 11 are flow charts for explaining the operation of the embodiment.

When rhythm start switch 81 shown in FIG. 2 is depressed in this state, the rhythm start signal is fed to CPU 3. In response to this signal, CPU 3 executes a program routine as shown in FIG. 9. More specifically, in steps Sl and S2, CPU 3 reads out the count value of tempo counter 52 until the count value is incremented. In step S3, CUP 3 checks whether "on" timing data "1" is set in rhythm generation flag register 72. Initially, no data is read out from timing register 13, so that data in rhythm generation flag register 72 is "0". At this timing, therefore, CPU determines that there is no need of sounding. In subsequent step S5, CPU 3 reads out timing data of the next timing from timing register 13 shown in FIG. 4.

Since the first timing data at this time is "1", CPU 3 determines, in step S6, that it is the timing for rhythm sounding. Consequently, it sets, in step S7, data "1" in rhythm generation flag register 72. Then in step S8, it executes a sub-routine of setting the sounding source. If the result of check in step S6 is NO, step S9 is executed, in which CPU 3 sets data "0" in register 72.

Figure 10:
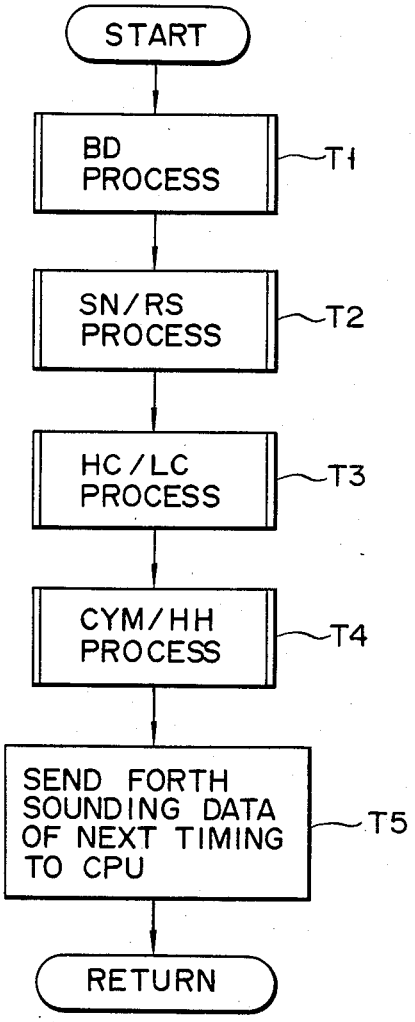

FIG. 10 shows the sub-routine of setting the sounding source. As is shown, CPU 3 performs the setting of sounding source independently for the seven different rhythm sources such as bass drum (BD) through steps T1 to T4. More specifically, in step T1 CPU 3 sets bass drum (DB) as sounding source. In step T2, it sets snare drum (SN)/rim shot (RS). In step T3, it sets high conga (HH)/low conga (LC). In step T4, it sets high hat (HH)/cymbal (CYM).

Figure 11:
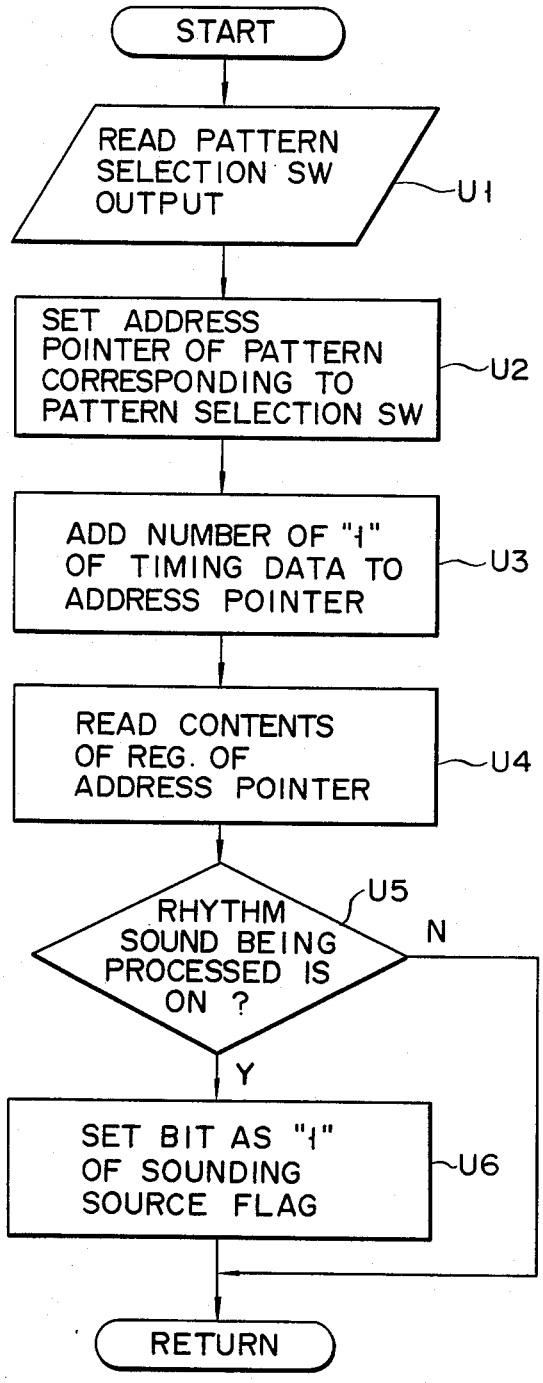

FIG. 11 shows a sub-routine of setting the sounding source for each rhythm sound. This routine will be described by taking bass drum (BD) as an example. In step Ul, CPU 3 reads that pattern selection switch lever 21*a* for the bass drum is at pattern position I. In subsequent step U2, it sets the first address value of "0" of area I of on/off register 12 in address pointer register 74. In subsequent step U3, CPU 3 adds to the address value "0" the number of times "1" data has been read out as timing data to set the address of on/off register 12 for the next sounding. At this instant, no "1" has yet been read out, so that there is "0" data in timing data "1" counting register 75 and the address value remains "0". In subsequent step U4, CPU 3 reads out on/off data in on/off register 12 in the "0" address for the bass drum (BD). Since this on/off data is "1", CPU 3 determines, in step U5, that bass drum (BD) is to be sounded at the next timing. Hence, in step U6, CPU 3 sets "1" in the bit of bass drum (BD) in sounding source flag register 73.

The setting of the sounding source is similarly done for other rhythms such as snare drum (SD) and rim shot (RS). In the case of the snare drum and rim shot, pattern II is designated, so that the address value at the time of the reading of on/off register 12 is set to "11". In the case of high hat (HH) and cymbal (CYM), pattern III is designated, so that the address value of on/off register 12 is set to "22", whereby on/off data is read out of the corresponding address.

In this way, data "0100001" showing the next rhythm pattern to be sounded is set in sounding source flag register 73. The data is set by CPU 3 in rhythm source 61 in step T5 shown in FIG. 10.

When the setting of sounding source, i.e., step S8 in FIG. 9, is over, the routine goes back to steps S1 and S2, in which CPU 3 detects the incrementation of the count of tempo counter 52. In subsequent step S7, it is detected that the set rhythm sounding flag is "1", so that CPU 3 determines, in step S3, that the rhythm pattern set in sounding source flag register 73 is to be sounded, and in step S4 it supplies a trigger pulse to rhythm source group 61 to cause the sounding of the rhythm.

In subsequent step S5, CPU 3 reads out the next second timing data from timing register 13. Since the second timing data here is "off" timing data of "0", CPU 3 determines in step S6 that this timing is not a timing of sounding. Thus, in step S9 it sets "0" in rhythm generation flag register 72.

Likewise, the next timing rhythm pattern is set in sounding source flag register 73 in steps S5 to S8, and the rhythm pattern is sounded in steps S1 through S4 with the progress of the tempo. If there is no timing of sounding, a stand-by state is set through step S9.

In the above way, bass drum (BD) and high conga (HC)/low conga (LC) are sounded with rhythm playing pattern represented by pattern I, snare drum (SN)/rim shot (RS) is sounded with pattern II, and high hat (HH)/cymbal (CYM) is sounded with pattern III.

If it is desired to switch the rhythm playing pattern represented by pattern III over to rhythm playing pattern represented by pattern II having stronger accent for the high hat/cymbal, lever 21*d* of pattern selection switch 21 is shifted to position II. When this is done so, the address pointer setting in step U2 is done not from "22" in area III but from "11" in area II. In this way, with the same rhythm of rock it is possible to obtain a rhythm pattern where only cymbal and high hat rhythm patterns are changed.

It is to be appreciated that with the same rhythm of rock $3^4=81$ different rhythm patterns can be obtained through switching of the patterns of the rhythm sources.

In the above embodiment, the rhythm pattern data is stored as separate on/off data, which only represents whether each rhythm source is "on" or "off", and timing data, which represents only the "on" timing". Thus, timing data for the individual rhythms can be collectively stored. Thus, the memory capacity can be reduced that much. Further, the rhythm pattern can be changed variously by merely slightly varying either timing data of on/off data.

Further, although in the above embodiment the rhythm pattern data has been stored as separate timing data and on/off data, the data may be stored collectively as a single data as well. Further, it is possible to provide more rhythm patterns than rhythm patterns I to III. Further, while in the above embodiment a plurality of different rhythms such as snare drum (SN) and rim shot (RS) are commonly switched by a common switch of the pattern selection switch, it is possible to let all the rhythms be switched independently of one another.

Further, the rhythm sound source group 21 which does not have a plurality of tone sources and only has a tone generating circuit for generating rhythm sounds in a time division manner may also be used in the invention.

As has been described in the foregoing, according to the invention a plurality of different pattern data is independently stored for each rhythm playing pattern of rock, disco, etc. for each of rhythm sources such as cymbal, high conga, bass drum, and the plurality of different patterns are designated for each rhythm source for sounding rhythm. Therefore, for the same rhythm pattern of rock, for instance, it is possible to produce variously changed rhythm patterns. The scope of variations of performance thus can be extended. Further, rhythm playing pattern data is stored for the individual rhythm source, and switching of rhythm playing patterns can be designated independently for only an intended rhythm source. It is thus possible to improve operability of changing rhythm patterns and permit switching of patterns even during the performance. The beginner thus can learn patterns for each rhythm source. Further, it is possible to recognize the pattern changes for the individual rhythm sources, which can help the formation of rhythm. Further, since it is possible to change only a specific rhythm source in the rhythm pattern, it is possible to vary the subtle nuance of rhythm even during performance.

What is claimed is:

1. An automatic rhythm playing apparatus comprising:

rhythm sound generating means for generating a plurality of different kinds of rhythm sounds;

rhythm pattern memory means for storing a plurality of kinds of rhythm playing pattern data corresponding to each of the different rhythm sounds being used to play specified rhythms;

pattern selection means for selectively designating one of said rhythm playing pattern data from said plurality of kinds of rhythm playing pattern data corresponding to each of selected different rhythm sounds;

tempo setting means for setting a tempo of an automatic rhythm play;

reading means for reading out rhythm playing pattern data designated by said pattern selection means according to a tempo set by said tempo setting means; and rhythm playing means for automatically playing a rhythm by driving said rhythm sound generating means according to the rhythm playing pattern data read out by said reading means, to thereby perform a read out rhythm pattern with a given kind of rhythm sound.

2. The apparatus according to claim 1, wherein said rhythm pattern memory means includes a ROM having registers, in which rhythm playing pattern data for each of said rhythm sounds is stored as separate on/off data for each rhythm sound and timing data representing the "on" timing of each rhythm.

3. The apparatus according to claim 2, wherein said rhythm pattern memory means further includes a RAM having a rhythm generation flag register, in which a flag is set when said on/off data is "on" data, an address pointer register, in which the number of "on" data in said timing data is set, and a sounding source flag register, in which on/off data is set.

4. The apparatus according to claim 1, wherein said pattern selection means has a plurality of switch levers each provided for each of said plurality of rhythm sounds, each said switch lever having a plurality of setting positions individually corresponding to said respective rhythm playing patterns.

5. The apparatus according to claim 1, wherein said rhythm playing pattern data includes chord/bass pattern data.

6. An automatic rhythm playing apparatus comprising:

rhythm kind selecting means for selectively designating one particular kind of rhythm from a plurality of kinds of rhythms;

rhythm pattern memory means for storing a plurality of kinds of rhythm playing pattern data corresponding to each of different rhythm sounds which may be used to play a particular kind of rhythm selected by said rhythm kind selecting means;

pattern selection means for selectively designating one of said rhythm playing pattern data from a plurality of kinds of rhythm playing pattern data stored in said rhythm pattern memory means;

rhythm sound generating means for generating a plurality of different rhythm sounds; and control means for reading out a particular kind of rhythm playing pattern data from a plurality of kinds of rhythm playing pattern data stored in said rhythm pattern memory means according to a selection of said pattern selection means corresponding to each of selected rhythm sounds used to play a particular kind of rhythm selected by said rhythm kind selecting means, and for driving said rhythm sound generation means according to said rhythm playing pattern data for controlling generation of predetermined rhythm sounds.

7. The apparatus according to claim 6, wherein said rhythm kind selecting means includes a manual operation means for designating kinds of the respective rhythms.

8. The apparatus according to claim 6, wherein said pattern selection means includes a manual operation means for selecting a specified rhythm playing pattern from a plurality of rhythm playing patterns for each of rhythm sounds.

9. The apparatus according to claim 6, wherein said control means includes a tempo signal generation means for generating a tempo signal, thereby determining a reading rate of rhythm playing pattern data read out of said rhythm pattern memory means.

* * * * *